United States Patent [19]

Stubenruss

[11] 4,127,057

[45] Nov. 28, 1978

[54] RECIPROCATING FLUID STROKE MOTORS WITH AUTOMATIC CONTROL

[76] Inventor: Paul Stubenruss, Kostlanerweg 4, Bressanone (Bolzano), Italy

[21] Appl. No.: 738,892

[22] Filed: Nov. 4, 1976

[30] Foreign Application Priority Data

Nov. 7, 1975 [IT] Italy ..... 29060 A/75

[51] Int. Cl.[2] ..... F01B 7/18; F01L 21/04; F01L 15/12; F01L 31/02

[52] U.S. Cl. ..... 91/52; 91/224; 91/229; 91/235; 91/347

[58] Field of Search ..... 91/229, 235, 224, 52, 91/335, 347

[56] References Cited

U.S. PATENT DOCUMENTS

| | | | |
|---|---|---|---|
| 126,623 | 5/1872 | Chandler | 91/229 |
| 529,581 | 11/1894 | Barnett | 91/229 |
| 1,142,551 | 6/1915 | Burnhart | 91/224 |
| 2,295,880 | 9/1942 | Valois et al. | 91/229 |
| 2,748,751 | 6/1956 | Johnson | 91/229 |
| 3,646,849 | 3/1972 | Smith | 91/52 |

FOREIGN PATENT DOCUMENTS

| | | | |
|---|---|---|---|
| 1,298,752 | 7/1969 | Fed. Rep. of Germany | 91/224 |

*Primary Examiner*—Paul E. Maslousky
*Attorney, Agent, or Firm*—Darbo & Vandenburgh

[57] ABSTRACT

A new control system is provided for a reciprocating fluid stroke motor of the type which is pressured at its rod end, reciprocation being achieved by intermittent exposure of its full blind-end face to the pressure fluid to overcome the pressure applied to its smaller rod-end face. The control means includes a valve for a passage through the piston, with adjustably-positioned trip-stops for shifting the valve between open and closed positions. The valve is biased to snap fully open when the piston movement toward its opening-stop opens it slightly and remain open until striking the closing-stop. Monostable or bistable trip-switch types of biasing means may be used, and unless one holding the valve closed with no fluid pressure is chosen, resumption of pressure supply after discontinuance will cause an initial retraction of the piston to its starting position, allowing time for the controlled apparatus to attain acceptable speed. Speed of operation can be controlled by adjustment of the constantly-constricted discharge port on the blind or full face side of the piston.

3 Claims, 3 Drawing Figures

RECIPROCATING FLUID STROKE MOTORS WITH AUTOMATIC CONTROL

INTRODUCTION

The invention relates to the control of differential-piston stroke motors of the reciprocating piston type, and has the purpose of providing an improved or simplified control of the piston when the cylinder is supplied with fluid pressure at one end and may have a constricted discharge at the other end.

Stroke motors of this type are common in machine-tool construction where it is used to achieve mere reciprocation, rather than rotation. According to the state of technology pulse valves, end-position valves and reversing valves are used for the control. Such a control is excessively expensive. The invention deals with the problem of making possible a control of fluid motors without the use of such expensive valves, in a simple but reliable manner to provide such operation characteristics as the following:

1. Automatic reciprocation (back-and-forth movement) of the piston;
2. Regulatable piston speed;
3. Variable stroke;
4. Stroke-stop with reversal;
5. Limit stroke-stops with operation suspended;
6. Retraction of the piston starting position, if desired, from every position after interruption of pressure.

The solution consists in the arrangement for control of the piston action by a single valve controlling a passage through the piston. The valve is biased in the open direction by a spring, and is further controlled by trip-stops.

In the appended drawing there are shown by way of example two forms of execution of the control according to the invention.

DESIGNATION OF FIGURES

BACKGROUND DESCRIPTION

Figure 1:
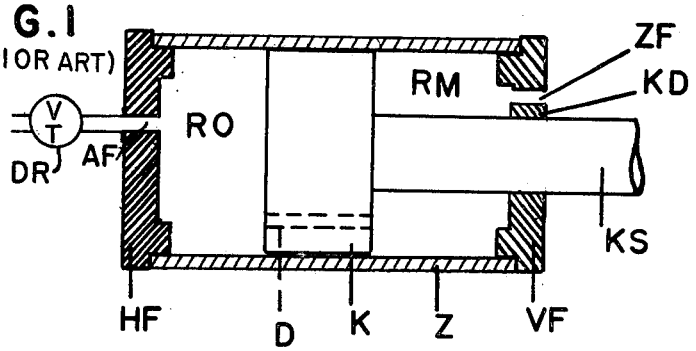
FIG. 1 (PRIOR ART)
FIG. 1 shows, diagrammatically, basic elements of a differential piston motor of known type, in longitudinal section.

The known differential piston motor according to FIG. 1 consists of the cylinder Z defining a cylinder chamber in which is a piston K with piston rod KS. The cylinder has a the main closure head VF at one end with passage opening KD in which the piston rod slides and with inflow port ZF for the pressure medium and another closure head HF at the other end with discharge port AF and variable choke DR. The differential piston K has a relatively small area face on the piston rod end thereof (i.e. the end in the primary chamber RM), a relatively large area face at the other end thereof (i.e. the end in the secondary chamber RO) and a piston-passage or flow-through opening D from the primary chamber RM to the secondary chamber RO. With the inflow of the pressure medium through the inflow port ZF, with piston passage D open and with discharge port AF closed or greatly constricted, the piston K is moved from left to right due to the fluid pressure providing a greater force when applied to the large area face of the piston as compared to the force produced by the application of the fluid to the small area face. With piston-passage D closed the piston is moved from right to left.

DESCRIPTION OF THE INVENTION

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the part, improvements or combinations in which the inventive concepts are found.

Figure 2:
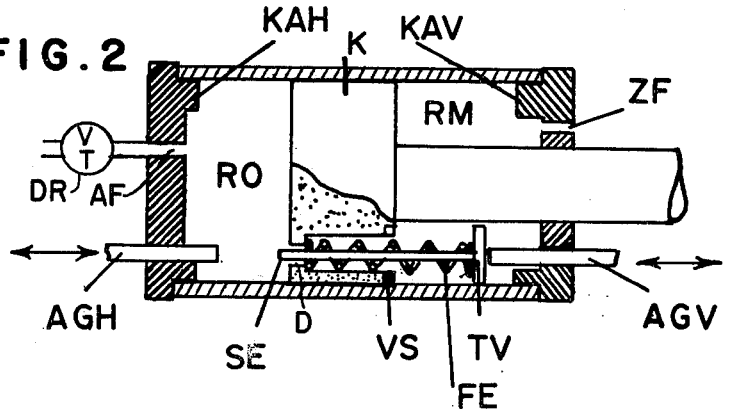
FIG. 2 shows similarly the control of the piston according to one embodiment of the invention.

The piston control according to the invention as shown in FIG. 2 consists of a valve TV with valve shaft SE and spring FE. The valve closes on a seat VS around the piston-passage D of the piston. Adjustable stops AGV and AGH extend through the supply and discharge heads, respectively, of the cylinder. The spring FE acts on the valve TV in the direction toward the closing stop AGV; i.e., the valve is biased by the spring in the "open" direction, so that the piston-passage D in the piston is normally open. When, therefore, the pressure fluid flows through the inflow opening ZF into the primary cylinder space RM, then, with piston-passage D open and discharge port AF closed or sufficiently choked, the piston will be shifted to the right. This piston movement continues until the valve TV, in consequence of striking the closing stop AGV, is pressed against the valve seat VS; and because the force of the spring FE is less than the force on valve TV resulting from the difference between the pressures prevailing in the two cylinder spaces RM and RO, the valve TV remains closed and the piston K is now moved to the left. Assuming that discharge port DR is constricted rather than closed, this movement continues until the valve shaft SE strikes the rear stop AGH to lift the valve from its seat. With the lifting of the valve TV from the valve seat, the differential pressure that has held the valve closed is reduced so as to be overcome by the spring force, and spring FE therefore snaps it to the fully open position, and holds it open as the piston retracts. With the flow of the pressure medium through the piston-passage D there begins a new control cycle for the piston, and the operation described is repeated. There are yielded, therefore, the following effects:

1. automatic back-and-forth movement (reciprocation) of the piston;
2. regulatable piston speed by means of adjusting the choke DR;
3. regulatable piston stroke through adjustment of the stops AGV and AGH;

4 and 5. if either stop AGV or stop AGH is backed off to allow the piston to strike against the limit stop, the piston remains standing in the position reached and will not move again until the appropriate stop AGV and AGH has been actuated from outside to close or open the valve TV;

6. if during the operation the pressure of the pressure medium is omitted or interrupted, then the valve TV is moved by spring FE into the position "open" and the piston remains standing; after resumption of pressure of the pressure fluid, the piston, regardless of the part of the cycle at which it stopped, moves to the right initially to commence its new cycling. If this is the retractive direction in operating a tool, this may be desirable for allowing an associated workpiece to resume an acceptable working speed before the tool is applied to it.

Figure 3:
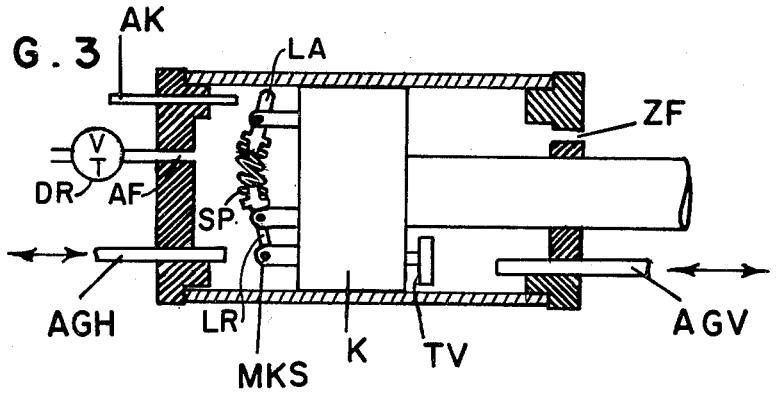
FIG. 3 shows similarly another embodiment of the control according to the invention.

In the modification according to FIG. 3, the need for careful selection of spring FE to be suitable for specific pressure differential is avoided by using instead of this spring a monostable, trip-switch type of biasing assembly MKS. This assembly is of a nature to exert no more than a relatively weak bias in the opening direction when the valve is fully closed, but a greater opening force as soon as tripping movement starts. In order in this modification to facilitate the snapping of the valve TV to open position and to maintain that position, the trip assembly can be cocked or pre-tensioned by a stop AK contacting lever arm LA just before being tripped by the stop AGH. If a bistable trip unit is chosen instead of the monostable trip unit, so that the valve TV is spring-biased open when open, the spring-biased closed when in closed position, there are likewise fulfilled all of the characteristics of operation mentioned except for point 6. Instead the cycle will continue from the point at which pressure was discontinued.

The pressure fluid both in the forward stroke and also in the return stroke of the piston discharges through the constricted discharge port AF. Since the opening of the valve TV and thereby relatively free flow of the fluid through the piston from primary space RM to secondary space RO causes the pressure in space RO to rise, there is a possibility, through use of a valve in discharge port AF which constricts further on pressure increase, to reduce the discharge of the fluid on movement of the piston to the right and thereby to increase the speed of this movement.

As illustrated in FIG. 3 the piston K would be moving to the right because of the substantially equal pressures acting on opposite sides of the piston and the area of the left side of the piston being larger than the area of the right side. Upon the piston moving sufficiently far to the right to cause the valve TV to contact the stop AGV the valve is thereby closed. When this occurs the lever LR of the monostable trip switch pivots clockwise thus causing spring SP thereof to move to the right, in turn causing lever LA to pivot counterclockwise. With valve TV closed and the pressure in the space to the left of the piston bleeding off through the variable choke DR, the fluid pressure acting on the piston causes the piston to commence to move to the left. Upon approaching the end of that stroke, initially the stop AK contacts lever arm LA to cock or pretension the strip switch MKS. Immediately thereafter the stop AGH engages the trip switch MKS. Immediately thereafter the stop AGH engages the trip switch to cause the trip switch valve TV to return to the FIG. 3 position. The stroke of the piston to the right in FIG. 3 then commences.

ACHIEVEMENT

Both illustrated forms of the invention provide simple, reliably operation and less expensive construction as compared to the conventional controls of comparable performance. There may also be achieved the point 6 of the list of characteristics, namely, automatic retraction when pressure fluid is resupplied after any discontinuance. This can be quite useful in machine tools. For example, in the feed thrust of the tool slide of a lathe, it is advantageous that in the case of standstill of the machine tool on account of pressure dropout, the tool on resumption of the pressure will immediately be retracted so that the feed movement recommences from the beginning. This assures a time for the machine to come up to normal or acceptable speed before the tool is applied to the work.

I claim:

1. A differential motor comprising a cylinder with two ends, an internal cylinder chamber, means for introducing fluid under pressure into said cylinder chamber, a discharge port communicating with said chamber at one of said ends and a variable choke at said port for controlling the rate of fluid flow exhausted from said chamber through said port, and a differential piston in said cylinder chamber, said piston having a relatively large area face facing said one end of said cylinder, a relatively small area face facing the other of said ends and an opening therethrough between said faces, whereby when said fluid is introduced into said cylinder chamber said piston is driven thereby toward the other of said ends by said pressurized fluid acting against both of said faces, said motor being characterized by:

valve means on said piston and movable between a first position at which said opening is closed and a second position at which said opening is open for the passage of fluid therethrough;

spring means engaging said valve means of said piston and, when said valve means is in said second position, applying a force to said valve means tending to maintain said valve means in said second position;

and actuating means mounted on said cylinder and extending into said chamber for moving said valve means to said first position as said piston moves toward the other of said ends whereupon said piston is driven toward said one end by said pressurized fluid, and for moving said valve means to said second position as said piston moves toward said one end whereupon said piston is driven toward said other end by said pressurized fluid.

2. A differential motor as set forth in claim 1, wherein said actuating means includes a pair of stops extending through said cylinder into said chamber, one of said stops having a portion adjacent one of said ends and the other stop having a portion adjacent the other of said ends.

3. A differential motor as set forth in claim 1, wherein said spring means comprises a bistable trip switch.

* * * * *

UNITED STATES PATENT AND TRADEMARK OFFICE

CERTIFICATE OF CORRECTION

PATENT NO. : 4,127,057

DATED : November 28, 1978

INVENTOR(S) : Paul Stubenruss

It is certified that error appears in the above-identified patent and that said Letters Patent are hereby corrected as shown below:

Column 2, line 63, "and" should read --or--.
Column 3, line 24, "the" should read --but--.
Column 3, lines 57-58, "Immediately thereafter the stop AGH engages the trip switch MKS." should be deleted.
Column 4, line 40, "of" should read --and--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*